US010184224B2

(12) United States Patent
Ito et al.

(10) Patent No.: US 10,184,224 B2
(45) Date of Patent: Jan. 22, 2019

(54) QUICK COUPLER

(71) Applicant: KOMATSU LTD., Tokyo (JP)

(72) Inventors: Daijiro Ito, Hirakata (JP); Tsuyoshi Yoshida, Tokyo (JP); Akira Hashimoto, Hirakata (JP); Takuya Tsukada, Takatsuki (JP); Kenichi Higuchi, Hirakata (JP)

(73) Assignee: KOMATSU LTD., Tokyo (JP)

( * ) Notice: Subject to any disclaimer, the term of this patent is extended or adjusted under 35 U.S.C. 154(b) by 273 days.

(21) Appl. No.: 15/315,902

(22) PCT Filed: Jun. 23, 2015

(86) PCT No.: PCT/JP2015/068062
§ 371 (c)(1),
(2) Date: Dec. 2, 2016

(87) PCT Pub. No.: WO2015/199082
PCT Pub. Date: Dec. 30, 2015

(65) Prior Publication Data

US 2017/0107687 A1 Apr. 20, 2017

(30) Foreign Application Priority Data

Jun. 26, 2014 (JP) ..... 2014-131346

(51) Int. Cl.
*E02F 3/36* (2006.01)

(52) U.S. Cl.
CPC ..... *E02F 3/3663* (2013.01); *E02F 3/3604* (2013.01); *E02F 3/3618* (2013.01); *E02F 3/3645* (2013.01)

(58) Field of Classification Search
CPC ..... E02F 3/3604; E02F 3/3645; E02F 3/3609; E02F 3/3618; E02F 3/3627; E02F 3/365; E02F 3/3663
See application file for complete search history.

(56) References Cited

U.S. PATENT DOCUMENTS 5,692,325 A * 12/1997 Kuzutani ..... E02F 3/3618 37/406
6,902,346 B2 * 6/2005 Steig, Jr. ..... E02F 3/3618 37/468

(Continued)

FOREIGN PATENT DOCUMENTS

FR 2724957 A1 * 3/1996 ..... E02F 3/3622
JP 7-166571 A 6/1995

(Continued)

OTHER PUBLICATIONS

International Search Report for the corresponding international application No. PCT/JP2015/068062, dated Sep. 29, 2015.

*Primary Examiner* — Matthieu F Setliff
(74) *Attorney, Agent, or Firm* — Global IP Counselors, LLP

(57) ABSTRACT

An edge of a guide hole includes a first contact portion, a second contact portion, and a guide portion. The first contact portion is in contact with the second connecting pin while the second connecting pin is positioned in the lock actuation position. The second contact portion is in contact with the second connecting pin while the second connecting pin is positioned in the lock release position. The guide portion extends in a direction intersecting the movement direction of the second connecting pin between the first contact portion and the second contact portion. The guide portion is pressed by the second connecting pin that moves from the lock actuation position to the lock release position in order to resist the urging force of an urging member and cause the second lock member to move from the locked position to the unlocked position.

9 Claims, 9 Drawing Sheets

(56) References Cited

U.S. PATENT DOCUMENTS 6,922,926 B2 * 8/2005 Miller ..... E02F 3/3618 37/468
7,493,712 B2 * 2/2009 McCormick ..... E02F 3/3618 37/468
7,594,776 B2 * 9/2009 Steig, Jr. ..... E02F 3/3618 37/468
7,648,305 B2 * 1/2010 Beales ..... E02F 3/3618 172/272
7,984,575 B2 * 7/2011 Robl ..... E02F 3/3622 172/273
7,984,576 B2 * 7/2011 Miller ..... E02F 3/3618 37/468
8,177,454 B2 * 5/2012 Steig, Jr. ..... E02F 3/3618 37/468
8,256,148 B2 * 9/2012 Miller ..... E02F 3/3618 37/468
8,262,310 B2 * 9/2012 Sikorski ..... E02F 3/3618 37/468
8,281,506 B2 * 10/2012 Stefek ..... E02F 3/3618 37/468
8,328,459 B2 * 12/2012 Hill ..... E02F 3/3622 172/272
8,448,357 B2 * 5/2013 Miller ..... E02F 3/3618 37/468
8,556,534 B2 * 10/2013 Lim ..... E02F 3/3618 403/322.3
8,684,623 B2 * 4/2014 Robl ..... F16D 1/00 37/468
8,690,515 B2 * 4/2014 Miller ..... E02F 3/3618 172/272
8,782,931 B2 * 7/2014 Balemi ..... E02F 3/3618 37/468
8,869,437 B2 * 10/2014 Robl ..... E02F 3/3618 37/468
9,194,097 B2 * 11/2015 Balemi ..... E02F 3/3618
9,217,235 B2 * 12/2015 Robl ..... E02F 3/3618
9,228,314 B2 * 1/2016 Robl ..... E02F 3/3663
9,670,642 B2 * 6/2017 Pesch ..... E02F 3/3618
9,903,091 B2 * 2/2018 Tsukada ..... E02F 3/3604
10,066,359 B2 * 9/2018 De Courcey ..... E02F 3/3618
2003/0154636 A1 8/2003 Miller et al.
2003/0175072 A1 * 9/2003 Steig, Jr. ..... E02F 3/3618 403/322.1
2005/0214105 A1 * 9/2005 Steig, Jr. ..... E02F 3/3618 414/723
2007/0199214 A1 * 8/2007 McCormick ..... E02F 3/3618 37/468
2008/0193210 A1 * 8/2008 Beales ..... E02F 3/3618 403/326
2009/0007465 A1 * 1/2009 Robl ..... E02F 3/3622 37/468
2009/0282712 A1 * 11/2009 Pruszynski ..... E02F 3/3618 37/468
2009/0311086 A1 * 12/2009 Steig, Jr. ..... E02F 3/3618 414/723
2010/0067982 A1 * 3/2010 Hill ..... E02F 3/3622 403/321
2010/0107456 A1 * 5/2010 Miller ..... E02F 3/3618 37/468
2010/0124453 A1 * 5/2010 Sikorski ..... E02F 3/3618 403/19
2010/0150643 A1 6/2010 Puttmann
2011/0209608 A1 * 9/2011 Stefek ..... E02F 3/3618 91/420
2011/0232070 A1 * 9/2011 Miller ..... E02F 3/3618 29/525
2012/0093572 A1 * 4/2012 Lim ..... E02F 3/3618 403/31
2012/0230760 A1 * 9/2012 Reay ..... E02F 3/3618 403/316
2012/0237327 A1 * 9/2012 Miller ..... E02F 3/3618 414/723
2012/0266432 A1 * 10/2012 Balemi ..... E02F 3/3618 29/426.1
2012/0291316 A1 * 11/2012 Miller ..... E02F 3/3618 37/195
2013/0008153 A1 * 1/2013 Stefek ..... E02F 3/3618 60/327
2013/0160269 A1 6/2013 Parker et al.
2013/0318841 A1 * 12/2013 Robl ..... E02F 3/3618 37/468
2013/0322954 A1 * 12/2013 Robl ..... E02F 3/3618 403/35
2013/0322959 A1 * 12/2013 Robl ..... F16D 1/00 403/326
2014/0301779 A1 * 10/2014 Balemi ..... E02F 3/3618 403/374.2
2014/0331663 A1 * 11/2014 Robl ..... E02F 3/3663 60/435

FOREIGN PATENT DOCUMENTS

JP 2003-64716 A 3/2003
JP 2003-522859 A 7/2003
JP 2010-523908 A 7/2010
WO WO-2012156672 A1 * 11/2012 ..... E02F 3/3618
WO WO-2012156673 A1 * 11/2012 ..... E02F 3/3618

* cited by examiner

QUICK COUPLER

CROSS-REFERENCE TO RELATED APPLICATIONS

This application is a U.S. National stage application of International Application No. PCT/JP2015/068062, filed on Jun. 23, 2015. This U.S. National stage application claims priority under 35 U.S.C. § 119(a) to Japanese Patent Application No. 2014-131346, filed in Japan on Jun. 26, 2014, the entire contents of which are hereby incorporated herein by reference.

BACKGROUND

Field of the Invention

The present invention relates to a quick coupler.

Background Information

Various types of attachments such as a bucket, a cutter, a breaker, forks and the like are attached to a work vehicle such as a hydraulic excavator. A quick coupler is known as a component for easily attaching these types of attachments to the work vehicle. The quick coupler is attached to the work vehicle.

For example, the quick coupler described in Japanese Laid-Open Patent Publication No. H7-166571 includes a fixed hook and a movable hook and these hooks lock onto two pins provided on the attachment whereby the attachment is connected to the quick coupler.

When the attachment is attached to the quick coupler with the abovementioned hooks, a lock member is preferably provided in order to prevent the pins from becoming disengaged from the hooks. For example, the quick coupler described in Japanese Laid-Open Patent Publication No. H7-166571 is made to prevent the disengagement of the pins from the hooks by inserting a lock pin in a boss provided on the movable hook.

SUMMARY

However, the lock pin is installed by an operator in the quick coupler described in Japanese Laid-Open Patent Publication No. H7-166571 Because this type of work is complicated, a disengagement prevention function is preferably carried out automatically with the lock member when attaching the attachment. Moreover, the disengagement prevention function with the lock member can be automatically released when detaching the attachment.

An object of the present invention is to provide a quick coupler that can enable the automatic actuation and release of a disengagement prevention function with the lock member when attaching and detaching the attachment.

A quick coupler according to a first aspect of the present invention is provided with a coupler body, a movable member, a hydraulic cylinder, and a second connecting pin, a second lock member, and an urging member. The coupler body includes a first hook. The movable member includes a second hook and is supported in a movable manner on the coupler body. The hydraulic cylinder includes a first end portion connected to the coupler body and a second end portion connected to the movable member. The hydraulic cylinder expands to cause the movable member to move so that the second hook moves away from the first hook. The hydraulic cylinder contracts to cause the movable member to move so that the second hook moves closer to the first hook.

The second connecting pin connects the second end portion of the hydraulic cylinder to the movable member.

The second lock member is provided to allow movement to a locked position and an unlocked position. The second lock member protrudes into an opening of the second hook in the locked position. The second lock member enters a state of retracting from the locked position in the unlocked position. The urging member urges the second lock member toward the locked position.

The movable member includes a second support hole. The second support hole supports the second connecting pin in a movable manner between a lock release position and a lock actuation position along the expansion and contraction direction of the hydraulic cylinder. The hydraulic cylinder expands whereby the second connecting pin moves from the lock release position to the lock actuation position. The cylinder contracts whereby the second connecting pin moves from the lock actuation position to the lock release position. The second lock member includes a guide hole disposed so as to overlap the second support hole. The second connecting pin is inserted into the second support hole and the guide hole.

The edge of the guide hole includes a first contact portion, a second contact portion, and a guide portion. The first contact portion is in contact with the second connecting pin while the second connecting pin is positioned in the lock actuation position. The second contact portion is in contact with the second connecting pin while the second connecting pin is positioned in the lock release position. The guide portion extends in a direction that intersects the movement direction of the second connecting pin between the first contact portion and the second contact portion. The guide portion is pressed by the second connecting pin that moves from the lock actuation position to the lock release position, thereby resisting the urging force of the urging member and causing the second lock member to move from the locked position to the unlocked position.

The second end portion of the hydraulic cylinder moves way from the first end portion due to the expansion of the hydraulic cylinder in the quick coupler according to the present aspect. As a result, the second hook moves away from the first hook. Consequently, the first hook and the second hook both lock onto pins of an attachment and the attachment is attached to the quick coupler.

Moreover, when the hydraulic cylinder expands, the second connecting pin moves from the lock release position to the lock actuation position. At this time, the second lock member moves from the unlocked position toward the locked position due to the urging force of the urging member. As a result, the disengagement prevention function by the second lock member is automatically actuated.

Conversely, the second end portion of the hydraulic cylinder moves closer to the first end portion due to the contraction of the hydraulic cylinder. As a result, the second hook moves closer to the first hook. Consequently, the first hook and the second hook both disengage from the pins of the attachment and the attachment is released from the quick coupler.

Moreover, when the cylinder contracts, the second connecting pin moves from the lock actuation position to the lock release position. At this time, the guide portion of the second lock member is pressed by the second connecting pin whereby the second lock member resists the urging force of the urging member and moves from the locked position to the unlocked position. As a result, the disengagement prevention function by the second lock member is automatically released.

The second support hole preferably is an elongated hole that extends in the expansion and contraction direction of the hydraulic cylinder. In this case, the second end portion moves in the expansion and contraction direction of the hydraulic cylinder along the elongated hole whereby the disengagement prevention function by the second lock member can be actuated. As a result, the construction of the quick coupler can be simplified.

The second lock member preferably is supported by the movable member to allow rotation between the locked position and the unlocked position. In this case, the second lock member can be supported with a simple construction.

The edge of the guide hole preferably includes a first corner portion, a second corner portion, a third corner portion, a first connecting portion, a second connecting portion, and a third connecting portion. The first corner portion includes the first contact portion. The second corner portion includes the second contact portion. The third corner portion is disposed in the movement direction of the second lock member with respect to the first corner portion. The first connecting portion includes the guide portion and connects the first corner portion and the second corner portion. The second connecting portion connects the second corner portion and the third corner portion. The third connecting portion connects the third corner portion and the first corner portion. In this case, the second lock member can be interlocked with the action of the second connecting pin with a simple construction.

The third corner portion of the guide hole preferably is disposed below a gap with respect to the second connecting pin positioned in the lock actuation position so that the second lock member is able to move from the locked position to the unlocked position while the second connecting pin is positioned in the lock actuation position.

In this case, the second lock member is able to move from the locked position to the unlocked position even when the second connecting pin is positioned in the lock actuation position. Therefore, the attachment pin is pushed against the second lock member from the outside of the opening of the second hook whereby the second lock member resists the urging force of the urging member and can be moved from the locked position to the unlocked position. As a result, the attachment pin can be inserted into the opening of the second hook even when the second lock member is positioned in the locked position.

The quick coupler is preferably further provided with a first lock member and a first connecting pin. The first lock member is provided in a manner that allows movement between the locked position and the unlocked position. The first lock member protrudes into an opening of the first hook in the locked position. The first lock member enters a state of retracting from the locked position in the unlocked position. The first connecting pin connects the first end portion of the hydraulic cylinder to the coupler body.

The coupler body includes a first support hole for movably supporting the first connecting pin in the expansion and contraction direction of the hydraulic cylinder. The first end portion of the hydraulic cylinder moves away from the second end portion within the movability range of the first connecting pin whereby the first lock member is moved from the unlocked position to the locked position.

In this case, when the hydraulic cylinder expands, the first end portion of the hydraulic cylinder moves away from the second end portion within the movability range of the first connecting pin. The first lock member moves from the unlocked position to the locked position in accompaniment to the action of the first end portion. Accordingly, the disengagement prevention function by the first lock member can be automatically actuated when attaching the attachment.

The first support hole preferably is an elongated hole that extends in the expansion and contraction direction of the hydraulic cylinder. In this case, the first end portion moves in the expansion and contraction direction of the hydraulic cylinder along the elongated hole whereby the disengagement prevention function by the first lock member can be actuated. As a result, the construction of the quick coupler can be simplified.

The quick coupler is preferably further provided with an elastic member inserted into the first support hole. The elastic member presses the first connecting pin in the direction from the second end portion toward the first end portion. In this case, the position of the first connecting pin is held due to the pressing force of the elastic member even if the expansion force of the hydraulic cylinder is lost due to a breakdown. As a result, the first lock member is held in the locked position.

The first end portion of the hydraulic cylinder preferably moves closer to the second end portion within the movability range of the first connecting pin whereby the first lock member is moved from the locked position to the unlocked position. In this case, the disengagement prevention function by the first lock member can be automatically released when detaching the attachment.

According to the present invention, the disengagement prevention function by the lock member can be automatically actuated when attaching the attachment, and the disengagement prevention function by the lock member can be automatically released when detaching the attachment.

DETAILED DESCRIPTION OF EMBODIMENT(S)

Figure 1:
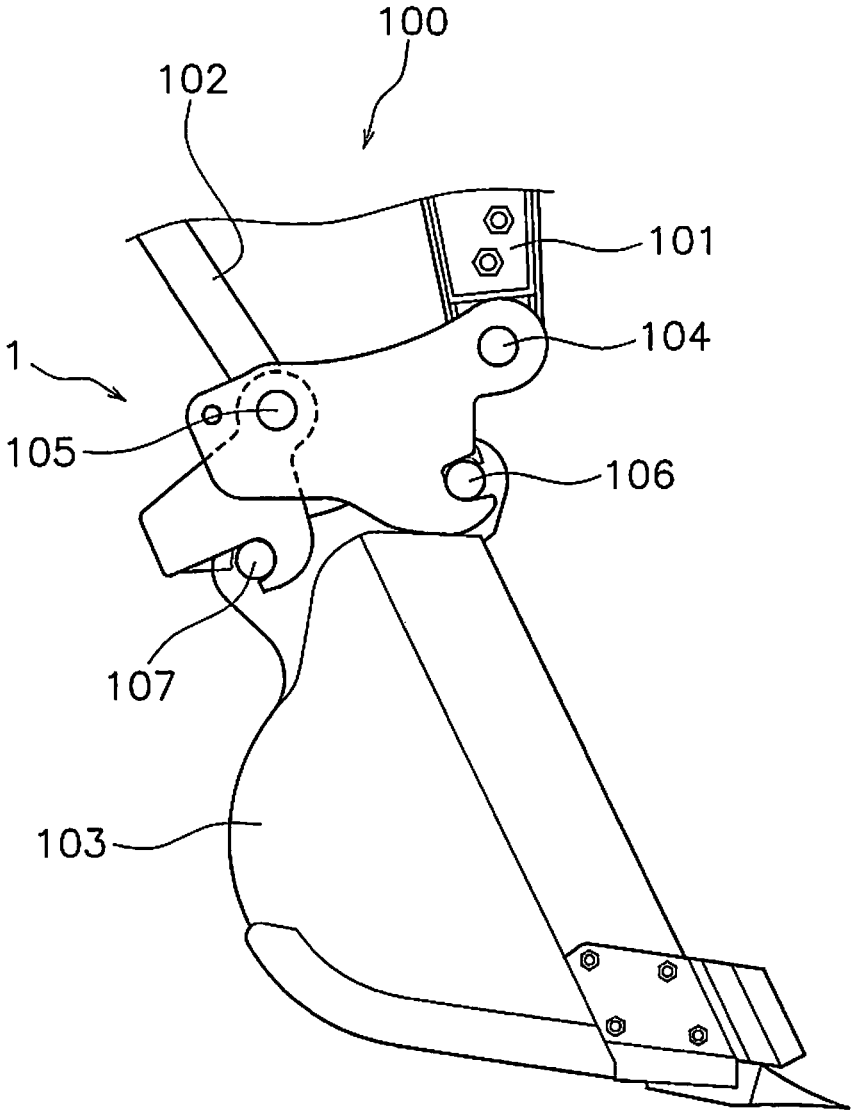
FIG. 1 is a side view of a portion of a hydraulic excavator having attached thereto a quick coupler according to an embodiment.

A quick coupler according to the embodiments will be discussed below with reference to the drawings. FIG. 1 is a side view of a portion of a work vehicle 100 having attached thereto a quick coupler 1 according to the present embodiment. The work vehicle 100 is a hydraulic excavator for example. However, the work vehicle 100 is not limited to a hydraulic excavator and may be another type of work vehicle.

As illustrated in FIG. 1, the work vehicle 100 includes an arm 101, a link member 102, and an attachment 103. While the attachment 103 is depicted as a bucket as an example in FIG. 1, the attachment 103 is not limited to a bucket and may be another type of attachment such as a cutter, a breaker, or forks and the like.

The quick coupler 1 is connected to the arm 101 via an arm pin 104. The quick coupler 1 is connected to the link member 102 via a link pin 105. The quick coupler 1 is connected to the attachment 103 via a first pin 106 and a second pin 107.

Figure 2:
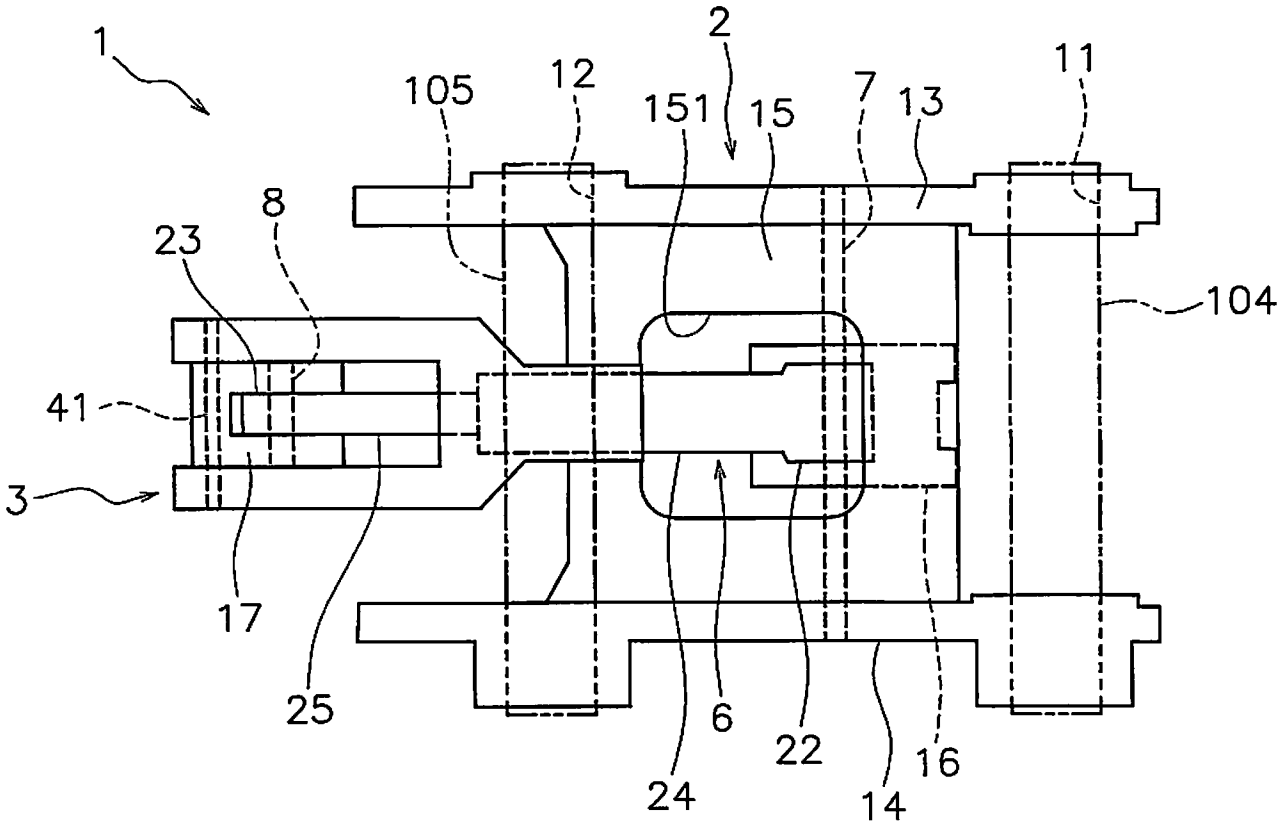
FIG. 2 is a plan view of the quick coupler.
Figure 3:
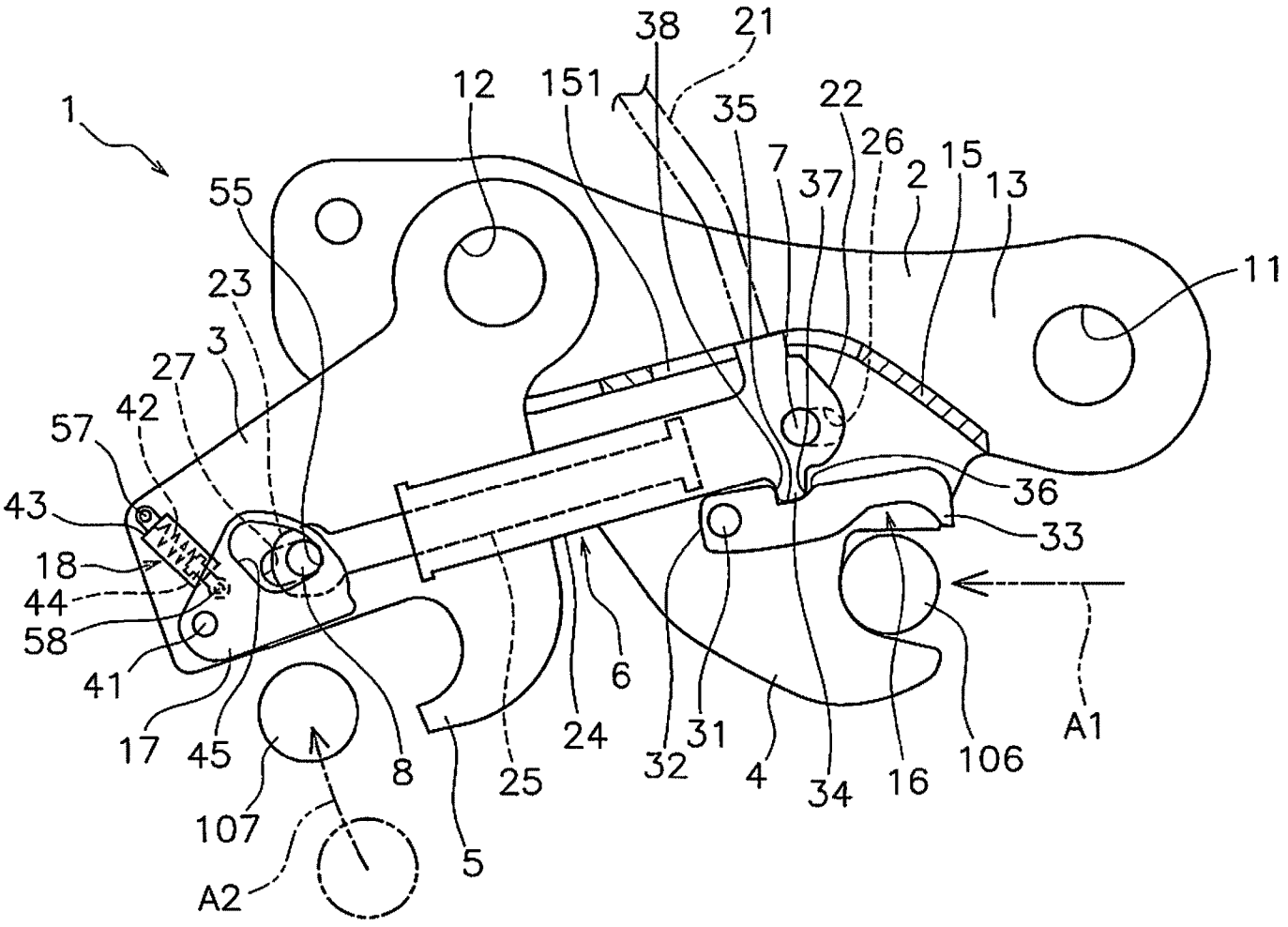
FIG. 3 is a side sectional view of a schematic configuration of the inside of the quick coupler.

FIG. 2 is a plan view of the quick coupler 1. FIG. 3 is a side sectional view of a schematic configuration of the inside of the quick coupler. As illustrated in FIGS. 2 and 3, the quick coupler 1 includes a coupler body 2 and a movable member 3. The coupler body 2 includes an arm pin support hole 11 and a link pin support hole 12. The arm pin 104 is inserted into the arm pin support hole 11. The link pin 105 is inserted into the link pin support hole 12.

The coupler body 2 includes a first hook 4. The first hook 4 locks onto the first pin 106. The movable member 3 is separate from the coupler body 2. The movable member 3 includes a second hook 5. The second hook 5 locks onto the second pin 107.

The direction in which the link pin support hole 12 is positioned with respect to the arm pin support hole 11 is referred to as forward and the opposite direction is referred to rearward in the quick coupler 1 according to the present embodiment. The direction where the first hook 4 and the second hook 5 are positioned with respect to the arm pin support hole 11 and the link pin support hole 12 is referred to as downward and the opposite direction is referred to as upward. An axial direction of the arm pin support hole 11 and an axial direction of the link pin support hole 12 is referred to as the width direction or laterally. However, the terms indicating the directions are specified when viewing the quick coupler 1 as described above and are not limited to the attachment direction of the quick coupler 1.

As illustrated in FIG. 2, the coupler body 2 includes a first side surface section 13, a second side surface section 14, and a wall section 15. The first side surface section 13 and the second side surface section 14 have a planar shape that extends in the front-back direction and the up-down direction. The first side surface section 13 and the second side surface section 14 are disposed with a gap therebetween in the width direction. The wall section 15 extends in the width direction and is disposed across the first side surface section 13 and the second side surface section 14. The arm pin support hole 11 and the link pin support hole 12 are provided so as to penetrate the first side surface section 13 and the second side surface section 14 in the width direction.

The movable member 3 is movably supported on the coupler body 2. Specifically, the movable member 3 is supported, via the link pin 105, in a manner that allows rotation with respect to the coupler body 2.

As illustrated in FIG. 3, the first hook 4 and the second hook 5 open in directions opposite from each other. Specifically the first hook 4 opens toward the rear. The second hook 5 opens toward the front. The second hook 5 is disposed in front of the first hook 4.

The quick coupler 1 includes a hydraulic cylinder 6, a first connecting pin 7, and a second connecting pin 8. The hydraulic cylinder 6 is connected to a hydraulic system of the work vehicle 100 via a hydraulic pipe 21. The hydraulic cylinder 6 expands and contracts due to hydraulic pressure from the hydraulic pipe 21.

The hydraulic cylinder 6 includes a first end portion 22 and a second end portion 23. The first end portion 22 is connected to the coupler body 2. The second end portion 23 is connected to the movable member 3. Specifically, the hydraulic cylinder 6 includes a cylinder tube 24 and a piston rod 25. The first end portion 22 is included in the cylinder tube 24. The second end portion 23 is included in the piston rod 25.

The first connecting pin 7 connects the first end portion 22 of the hydraulic cylinder 6 to the coupler body 2. The coupler body 2 includes a first support hole 26. The first support hole 26 is provided so as to penetrate the first side surface section 13 and the second side surface section 14. The first connecting pin 7 is attached to the first end portion 22, and the first end portion 22 is supported via the first connecting pin 7 on the coupler body 2.

The first connecting pin 7 is inserted into the first support hole 26. The first support hole 26 is an elongated hole that extends the expansion direction of the hydraulic cylinder 6. As a result, the first support hole 26 movably supports the first connecting pin 7 in the expansion and contraction direction of the hydraulic cylinder 6.

The second connecting pin 8 connects the second end portion 23 of the hydraulic cylinder 6 to the movable member 3. The movable member 3 includes a second support hole 27. The second support hole 27 is provided so as to penetrate the movable member 3 in the width direction. The second connecting pin 8 is attached to the second end portion 23, and the second end portion 23 is supported via the second connecting pin 8 on the movable member 3. The second support hole 27 is an elongated hole that extends the expansion and contraction direction of the hydraulic cylinder 6. As a result, the second support hole 27 movably supports the second connecting pin 8 in the expansion and contraction direction of the hydraulic cylinder 6.

As illustrated in FIGS. 2 and 3, the wall section 15 includes an opening 151. The opening 151 is positioned above the first end portion 22. As illustrated in FIG. 3, the hydraulic pipe 21 passes through the opening 151 and is guided into the coupler body 2.

Figure 4:
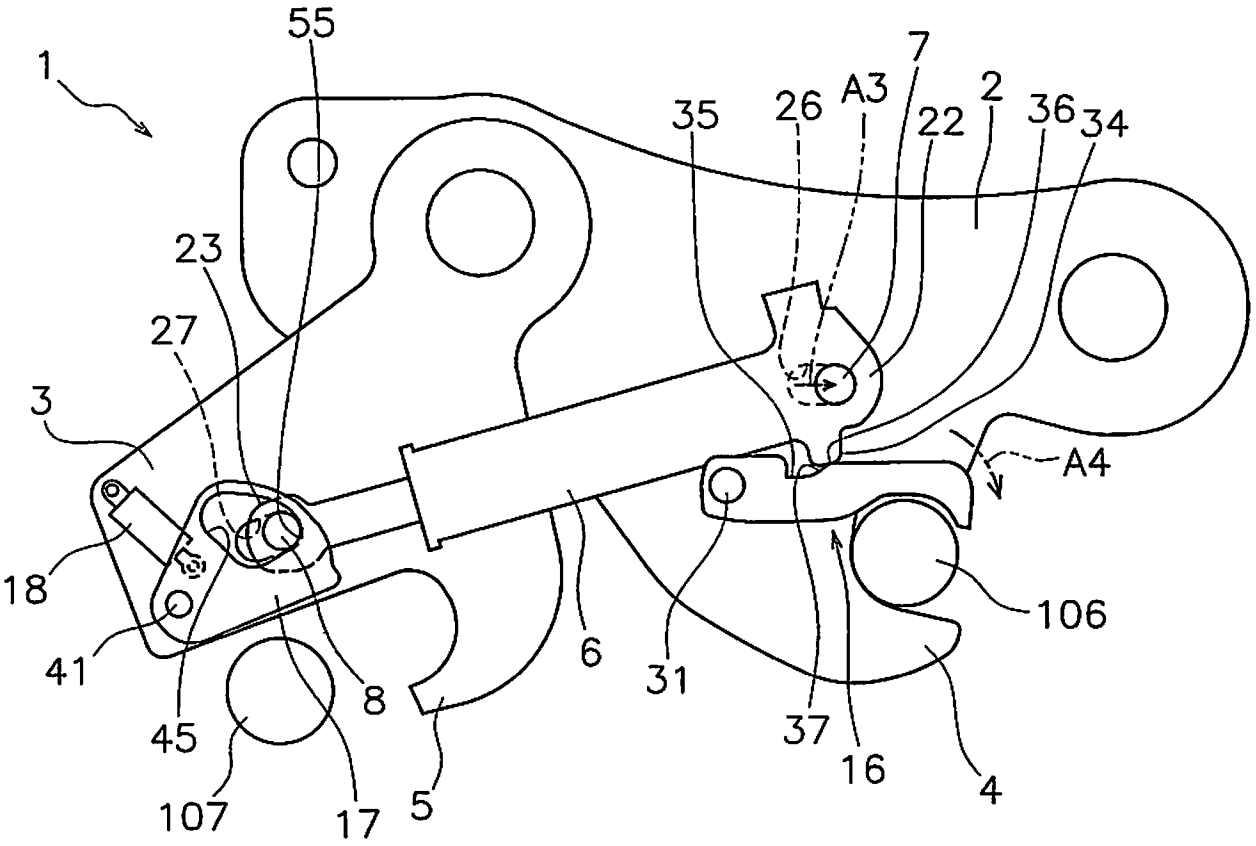
FIG. 4 is a side sectional view of a schematic configuration of the inside of the quick coupler.
Figure 5:
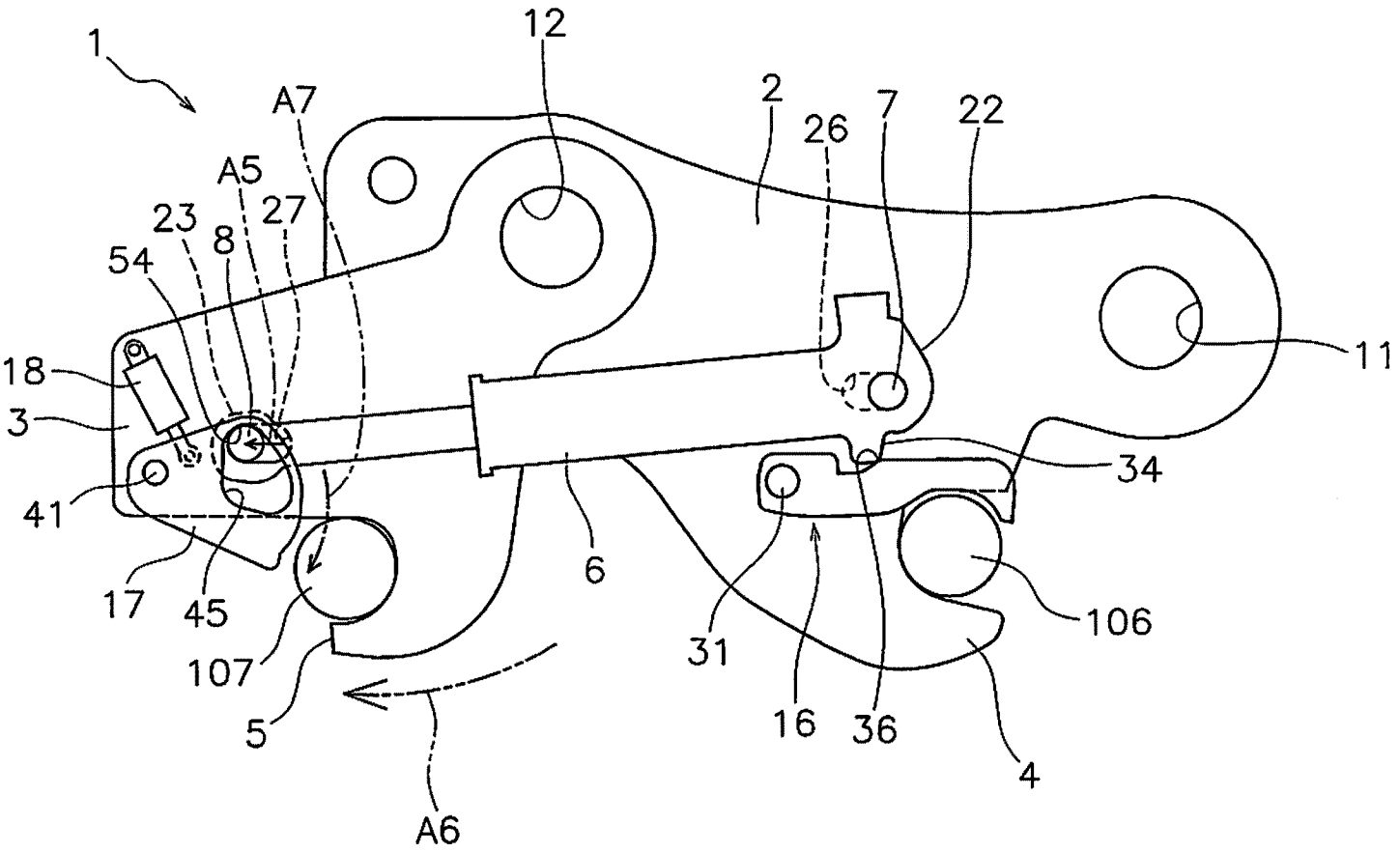
FIG. 5 is a side sectional view of a schematic configuration of the inside of the quick coupler.

FIG. 4 is a side surface cross-sectional view illustrating a state in which the hydraulic cylinder 6 is expanded from the state illustrated in FIG. 3. FIG. 5 is a side surface cross-sectional view illustrating a state in which the hydraulic cylinder 6 is further expanded from the state illustrated in FIG. 4. As illustrated in FIGS. 4 and 5, the second end portion 23 moves away from the first end portion 22 due to the expansion of the hydraulic cylinder 6. As a result, the hydraulic cylinder 6 causes the movable member 3 to rotate with respect to the coupler body 2 so that the second hook 5 moves away from the first hook 4.

Figure 6:
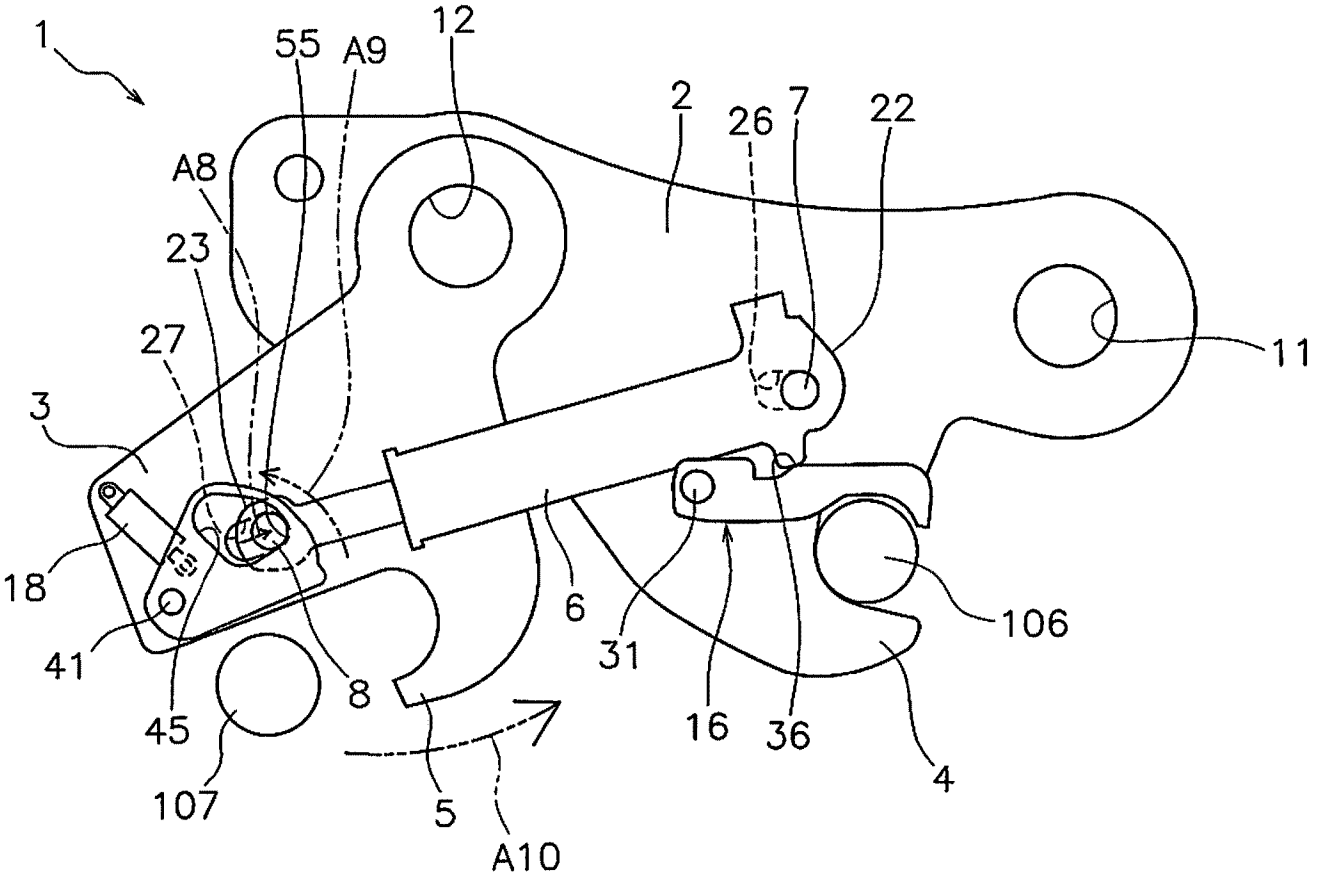
FIG. 6 is a side sectional view of a schematic configuration of the inside of the quick coupler.
Figure 7:
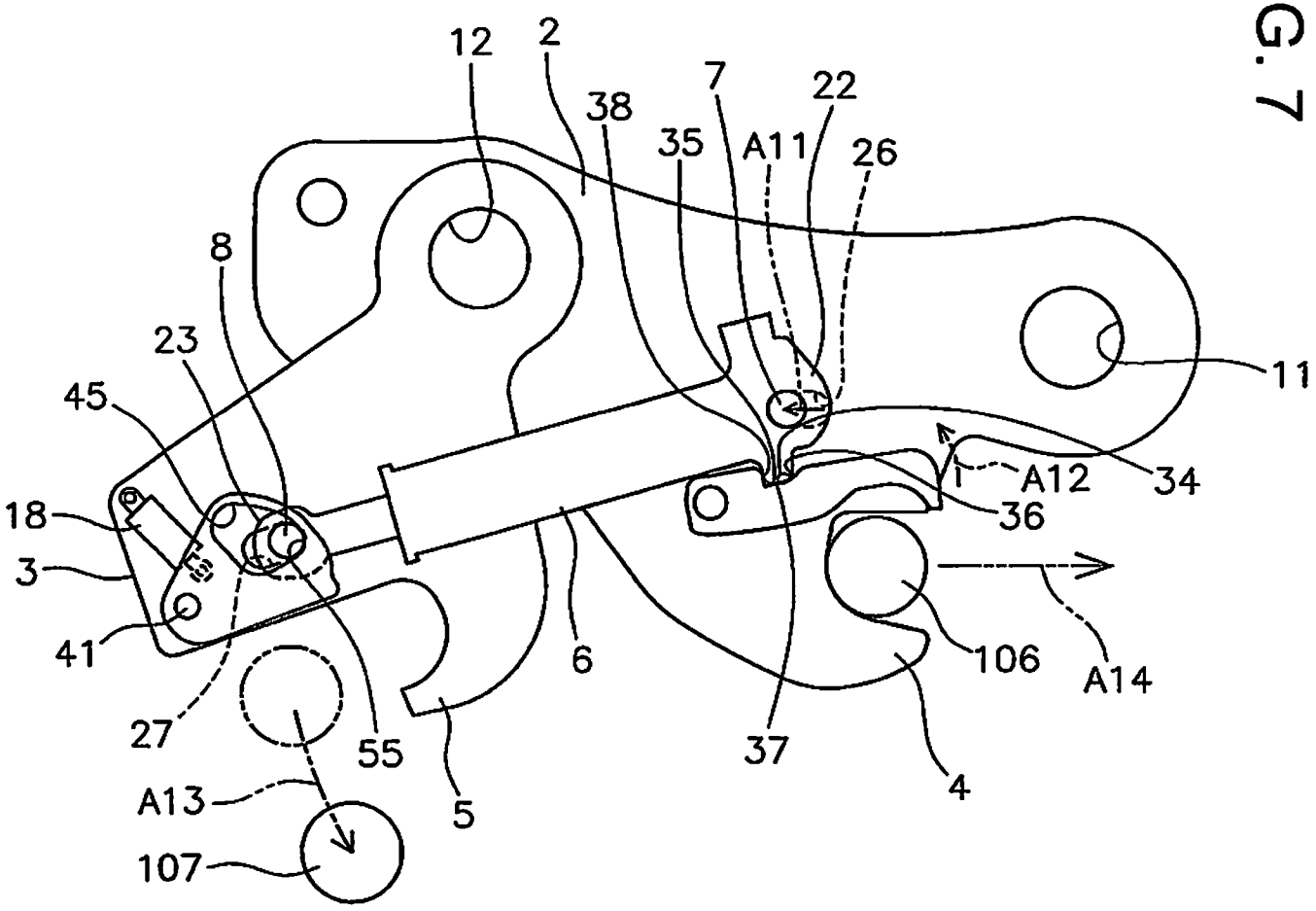
FIG. 7 is a side sectional view of a schematic configuration of the inside of the quick coupler.

FIG. 6 is a side surface cross-sectional view illustrating a state in which the hydraulic cylinder 6 is contracted from the state illustrated in FIG. 5. FIG. 7 is a side surface cross-sectional view illustrating a state in which the hydraulic cylinder 6 is contracted further from the state illustrated in FIG. 6. As illustrated in FIGS. 6 and 7, the second end portion 23 moves closer to the first end portion 22 due to the contraction of the hydraulic cylinder 6. As a result, the hydraulic cylinder 6 causes the movable member 3 to rotate with respect to the coupler body 2 so that the second hook 5 moves closer to the first hook 4.

A portion of the configuration illustrated in FIG. 3 is omitted from FIGS. 4 to 7 in order to facilitate understanding.

As illustrated in FIG. 3, the quick coupler 1 includes a first lock member 16, a second lock member 17, and an urging member 18. The first lock member 16 includes the function of automatically preventing the disengagement of the first hook 4 when the attachment 103 is attached. A configuration pertaining to the first lock member 16 is explained below.

The first lock member 16 is disposed above the first hook 4. The first lock member 16 is connected to the coupler body 2 via a first lock connecting pin 31. The first lock member 16 includes a base end portion 32 and a tip end portion 33. The base end portion 32 is supported in a rotatable manner on the coupler body 2. The tip end portion 33 has a hook-like shape that is curved downward. That is, the tip end portion 33 has a hook-like shape that is curved toward the first hook 4.

The first lock member 16 is provided to allow movement between a first locked position and a first unlocked position. FIG. 3 illustrates a state of the first lock member 16 positioned in the first unlocked position. FIGS. 4 and 5 illustrate states of the first lock member 16 positioned in the first locked position.

As illustrated in FIGS. 4 and 5, the tip end portion 33 of the first lock member 16 protrudes into the opening of the first hook 4 in the first locked position. As a result, disengagement of the first pin 106 from the first hook 4 is prevented. As illustrated in FIG. 3, the tip end portion 33 of the first lock member 16 enters a state of retracting from the first locked position in the first unlocked position. Specifically, the tip end portion 33 of the first lock member 16 enters a state of retracting from the inside of the opening of the first hook 4 in the first unlocked position.

The first end portion 22 of the hydraulic cylinder 6 moves to a holding position by moving away from the second end portion 23. FIG. 5 illustrates a state of the first end portion 22 positioned in the holding position. The first end portion 22 holds the first lock member 16 in the first locked position in the holding position. Conversely, the first end portion 22 moves to a release position by moving toward the second end portion 23. FIG. 3 illustrates a state of the first end portion 22 positioned in the release position. The first end portion 22 releases the hold of the first lock member 16 in the release position.

Specifically, the first end portion 22 of the hydraulic cylinder 6 includes a protruding portion 34 that protrudes toward the first lock member 16. The protruding portion 34 protrudes downward. The first lock member 16 includes a recessed portion 35 and a receiving portion 36. The recessed portion 35 and the receiving portion 36 are positioned between the base end portion 32 and the tip end portion 33. The recessed portion 35 has a shape that is recessed downward from the upper surface of the first lock member 16. The receiving portion 36 is positioned to the rear of the recessed portion 35.

As illustrated in FIG. 5, while the first end portion 22 is positioned in the holding position, the protruding portion 34 is in contact with the receiving portion 36 and the protruding portion 34 presses the first lock member 16 toward the first hook 4. As a result, the first lock member 16 is held in the first locked position. As illustrated in FIG. 3, the protruding portion 34 is positioned inside the recessed portion 35 while the first end portion 22 is positioned in the release position. As a result, the first lock member 16 is held in the first unlocked position.

More specifically, the first lock member 16 includes an inclined surface 37 and a step portion 38 connected to the recessed portion 35. The inclined surface 37 and the step portion 38 are positioned between the base end portion 32 and the tip end portion 33. The inclined surface 37 is disposed in the direction from the second end portion 23 to the first end portion 22 with respect to the recessed portion 35. That is, the inclined surface 37 is disposed to the rear of the recessed portion 35. The step portion 38 is disposed in the direction from the first end portion 22 to the second end portion 23 with respect to the recessed portion 35. That is, the step portion 38 is disposed in front of the recessed portion 35.

As illustrated in FIGS. 3 to 5, the protruding portion 34 moves from the recessed portion 35 to the inclined surface 37 and presses against the inclined surface 37 whereby the first lock member 16 rotates and moves to the first locked position. Moreover, as illustrated in FIGS. 6 and 7, the protruding portion 34 moves from the recessed portion 35 to the step portion 38 and presses against the step portion 38 whereby the first lock member 16 rotates and moves to the first unlocked position.

Figure 8:
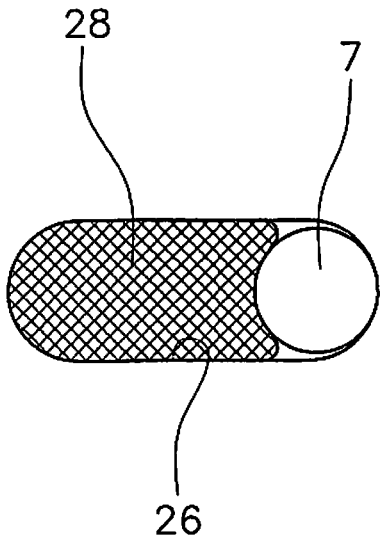
FIG. 8 is a side view of a first support hole and an elastic member.

The elastic member 28 is inserted into the first support hole 26 as illustrated in FIG. 8. The elastic member 28 is made of rubber for example. However, the elastic member 28 is not limited to rubber and may be another material so long as the material produces an elastic force. The elastic member 28 has a long thin shape that follows the first support hole 26.

Figure 9:
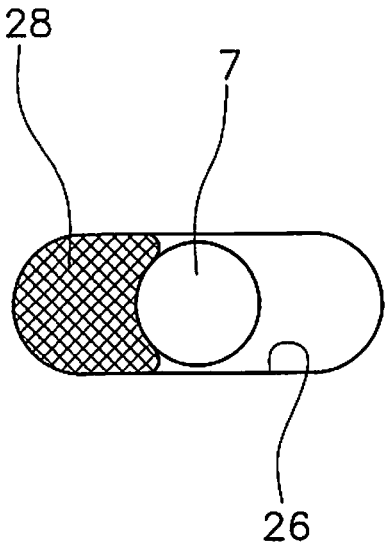
FIG. 9 is a side view of the first support hole and the elastic member.

FIG. 8 illustrates the first connecting pin 7 and the elastic member 28 while the first end portion 22 is positioned in the holding position (see FIG. 5). The elastic member 28 presses the first connecting pin 7 in the state illustrated in FIG. 8. FIG. 9 illustrates the first connecting pin 7 and the elastic member 28 while the first end portion 22 is moved from the holding position to the release position as illustrated in FIG. 6. As illustrated in FIG. 9, the first connecting pin 7 moves whereby the elastic member 28 is compressed by the first connecting pin 7. That is, the elastic member 28 is disposed so as to be compressed by the first connecting pin 7 when the hydraulic cylinder 6 contracts.

A configuration pertaining to the second lock member 17 is explained below. The second lock member 17 has the function of automatically preventing the release of the second hook 5 when the attachment 103 is attached. As illustrated in FIG. 3, the second lock member 17 is disposed in front of the second hook 5. The second lock member 17 is connected to the movable member 3 via a second lock connecting pin 41. The second lock member 17 is rotatably supported on the movable member 3 via the second lock connecting pin 41.

The second lock member 17 is provided in a rotatable manner between a second locked position and a second unlocked position. FIGS. 3 and 4 illustrate a state of the second lock member 17 positioned in the second unlocked position. FIG. 5 illustrate a state of the second lock member 17 positioned in the second locked position.

As illustrated in FIG. 5, the second lock member 17 protrudes into an opening of the second hook 5 in the second locked position. As illustrated in FIGS. 3 and 4, the second lock member 17 enters a state of retracting from the second locked position in the second unlocked position.

The urging member 18 urges the second lock member 17 toward the second locked position. The urging member 18 is connected to the movable member 3 via a connecting pin 57. The urging member 18 is connected to the second lock member 17 via a connecting pin 58. The urging member 18 includes a spring 42, a spring cover 43, and a shaft 44. The spring 42 is in a compressed state during either of the second locked position or the second unlocked position. The spring cover 43 houses the spring 42. The spring cover 43 is connected to the movable member 3 is a rotatable manner via the connecting pin 57. The shaft 44 is pressed by the spring 42 and protrudes from the spring cover 43. The shaft 44 is connected to the second lock member 17 in a rotatable manner via the connecting pin 58.

The abovementioned second support hole 27 supports the second connecting pin 8 in a movable manner between a lock release position and a lock actuation position along the expansion and contraction direction of the hydraulic cylinder 6. As explained below, the release position is the position for releasing the disengagement prevention function by the second lock member 17. The lock actuation position is a position for actuating the disengagement prevention function by the second lock member 17. The hydraulic cylinder 6 expands whereby the second connecting pin 8 moves from the lock release position to the lock actuation position. The hydraulic cylinder 6 contracts whereby the second connecting pin 8 moves from the lock actuation position to the lock release position.

The second lock member 17 includes a guide hole 45. The guide hole 45 is disposed so as to overlap the second support hole 27 as seen from the axial direction of the second connecting pin 8. The second connecting pin 8 is inserted into the second support hole 27 and the guide hole 45. The guide hole 45 has an approximately triangular shape including three corner portions.

Figure 10:
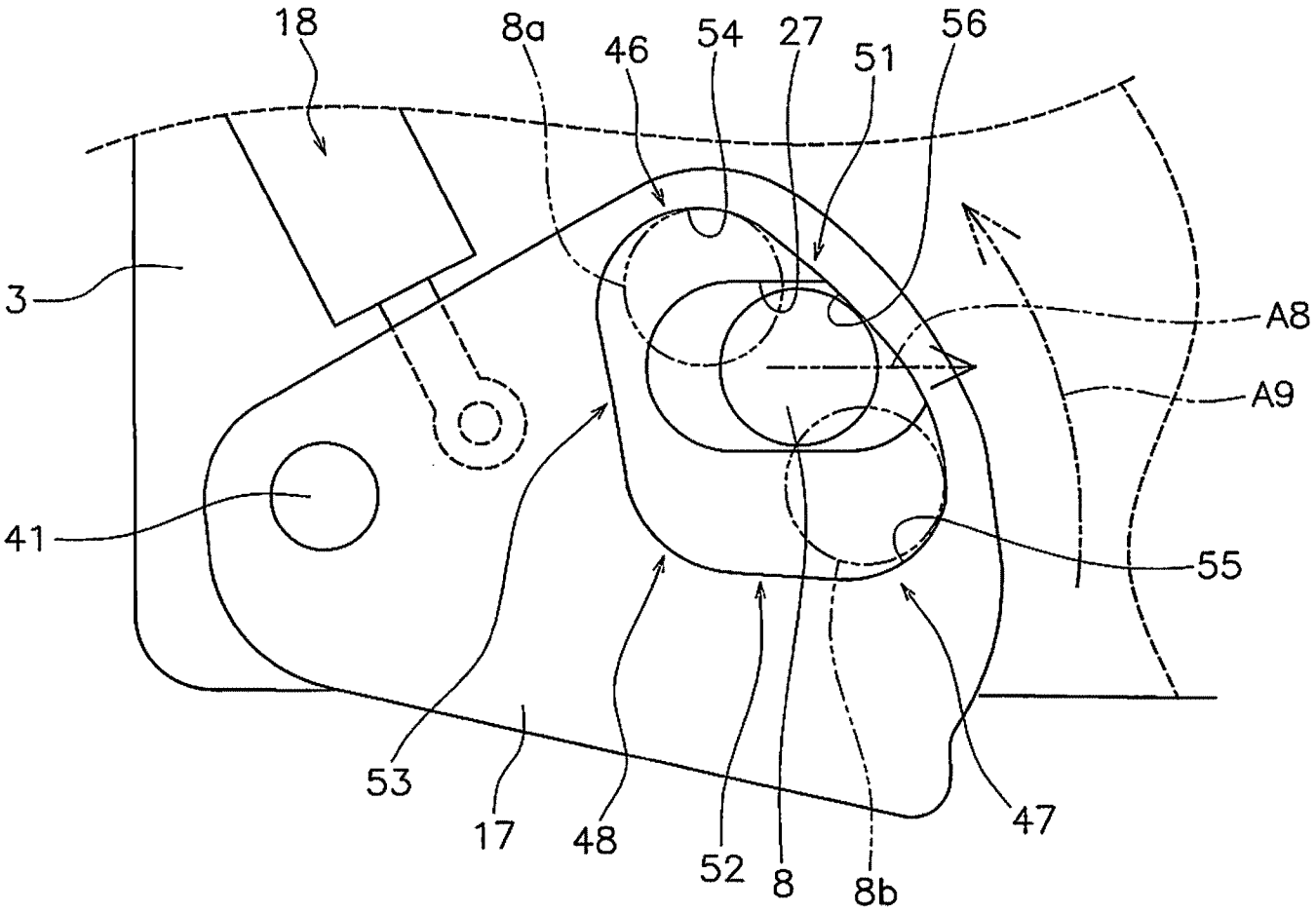
FIG. 10 is an enlarged view of a second lock member and the vicinity thereof.

FIG. 10 is an enlarged view of the second lock member 17 and the vicinity thereof. As illustrated in FIG. 10, the edge of the guide hole 45 includes a first corner portion 46, a second corner portion 47, a third corner portion 48, a first connecting portion 51, a second connecting portion 52, and a third connecting portion 53.

"8*a*" in FIG. 10 indicates the position of the second connecting pin 8 with respect to the second lock member 17 in the lock actuation position. "8*b*" indicates the position of the second connecting pin 8 with respect to the second lock member 17 in the lock release position. Moreover, "8" indicates the position of the second connecting pin 8 with respect to the second lock member 17 between the lock actuation position and the lock release position.

The first corner portion 46 includes a first contact portion 54. As illustrated in FIG. 5, the first contact portion 54 is in contact with the second connecting pin 8 while the second connecting pin 8 is positioned in the lock actuation position. The second corner portion 47 includes a second contact portion 55. As illustrated in FIG. 3, the second contact portion 55 is in contact with the second connecting pin 8 while the second connecting pin 8 is positioned in the lock release position. The third corner portion 48 is disposed in the movement direction of the second lock member 17 with respect to the first corner portion 46. The third corner portion 48 is positioned below the first corner portion 46. The third corner portion 48 is positioned in front of the second corner portion 47.

The first connecting portion 51 connects the first corner portion 46 and the second corner portion 47. The second connecting portion 52 connects the second corner portion 47 and the third corner portion 48. The third connecting portion 53 connects the third corner portion 48 and the first corner portion 46. The first connecting portion 51 includes a guide portion 56.

The guide portion 56 extends in the direction that intersects the movement direction (see arrow A8) of the second connecting pin 8 between the first contact portion 54 and the second contact portion 55. The guide portion 56 is pressed by the second connecting pin 8 when the second connecting pin 8 moves from the lock actuation position (8*a*) to the lock release position (8*b*). As a result, the second lock member 17 resists the urging force of the urging member 18 and moves from the second locked position to the second unlocked position.

The third connecting portion 53 extends downward from the second connecting pin 8 positioned in the lock actuation position (8*a*). Consequently as illustrated in FIG. 5, the edge of the guide hole 45 is disposed with a gap with respect to the second connecting pin 8 positioned in the lock actuation position. Specifically, the third corner portion 48 is disposed below the gap with respect to the second connecting pin 8 positioned in the lock actuation position (8*a*). That is, the guide hole 45 has a space in which the second connecting pin 8 can be disposed below the second connecting pin 8 positioned in the lock actuation position. As a result, the second lock member 17 is able to move from the second locked position to the second unlocked position while the second connecting pin 8 is positioned in the lock actuation position.

Next, operations for attaching the attachment 103 to the quick coupler 1 will be discussed. First, as illustrated in FIG. 3, the first pin 106 locks onto the first hook 4 (see arrow A1). Further, the quick coupler 1 or the attachment 103 rotates around the first pin 106 whereby the second pin 107 is disposed in front of the second hook 5 (see arrow A2). The hydraulic cylinder 6 then expands.

As illustrated in FIG. 4, the first end portion 22 moves toward the rear along the first support hole 26 so as to move away from the second end portion 23 when the hydraulic cylinder 6 expands (see arrow A3). As a result, the protruding portion 34 moves from the recessed portion 35 of the first lock member 16 to the inclined surface 37 and the first lock member 16 is rotated due to the protruding portion 34 pressing against the inclined surface 37 (see arrow A4).

Furthermore as illustrated in FIG. 5, the protruding portion 34 presses the receiving portion 36 of the first lock member 16 when the first end portion 22 reaches the release position. As a result, the first lock member 16 reaches the first locked position and the first pin 106 is prevented from disengaging from the first hook 4 due to the first lock member 16. Moreover, the protruding portion 34 presses against the receiving portion 36 whereby the first lock member 16 is held in the first locked position.

Moreover, the second end portion 23 moves forward so as to move away from the first end portion 22 due to the expansion of the hydraulic cylinder 6 (see arrow A5). As a result, the hydraulic cylinder 6 expands further whereby the movable member 3 rotates with respect to the coupler body 2 so that the second hook 5 moves away from the first hook 4 (see arrow A6). As a result, the second hook 5 locks onto the second pin 107.

Moreover, the hydraulic cylinder 6 expands whereby the second connecting pin 8 moves from the lock release position to the lock actuation position (see arrow A5). The pressing of the second lock member 17 toward the second unlocked position by the second connecting pin 8 is released while the second connecting pin 8 is positioned in the lock actuation position. As a result, the second lock member 17 moves toward the second locked position due to the urging force from the urging member 18 (see arrow A7). As a result, the second pin 107 is prevented from disengaging from the second hook 5 by the second lock member 17.

Next, actions for detaching the attachment 103 from the quick coupler 1 will be discussed. As illustrated in FIG. 6, the second end portion 23 moves toward the rear so as to move closer to the first end portion 22 due to the contraction of the hydraulic cylinder 6. As a result, the second connecting pin 8 moves from the lock actuation position toward the lock release position (see arrow A8). Consequently as illustrated in FIG. 10, the second connecting pin 8 presses the second lock member 17 toward the second unlocked position while sliding on the guide portion 56 of the second lock member 17. As a result, the second lock member 17 rotates toward the second unlocked position (see arrow A9). As a result, the disengagement prevention by the second lock member 17 is released.

The hydraulic cylinder 6 contracts further whereby the movable member 3 rotates with respect to the coupler body 2 so that the second hook 5 moves toward the first hook 4 (see arrow A10). As a result, the locking of the second hook 5 on the second pin 107 is released.

As illustrated in FIG. 7, the first end portion 22 moves forward along the first support hole 26 so as to move closer to the second end portion 23 due to the contraction of the hydraulic cylinder 6 (see arrow A11). As a result, the protruding portion 34 passes from the receiving portion 36 of the first lock member 16 to the inclined surface 37 and moves to the recessed portion 35. The protruding portion 34 then moves further to the rear and locks onto the step portion 38 whereby the first lock member 16 rotates (see arrow A12). As a result, the first lock member 16 moves to the first unlocked position and the disengagement prevention of the first pin 106 by the first lock member 16 is released.

Next, the quick coupler 1 or the attachment 103 rotates around the first pin 106 whereby the second pin 107 moves from the position facing the opening of the second hook 5 (see arrow A13). The first hook 4 then is detached from the first pin 106 (see arrow A14). As described above, the attachment 103 is detached from the quick coupler 1.

Moving the first lock member 16 to the first locked position (arrow A4 in FIG. 4) and rotating the second hook 5 (arrow A6 in FIG. 5) may be performed in any order when attaching the attachment 103 to the quick coupler 1. Similarly, moving the first lock member 16 to the first unlocked position (arrow A12 in FIG. 7) or rotating the second hook 5 (arrow A10 in FIG. 6) may be performed in any order when removing the attachment 103 from the quick coupler 1.

As described above, the disengagement prevention function can be automatically carried out due to the first lock member 16 and the second lock member 17 when attaching the attachment 103 in the quick coupler 1 according to the present embodiment. Moreover, the disengagement prevention function due to the first lock member 16 and the second lock member 17 can be automatically released when detaching the attachment 103.

The second pin 107 of the attachment 103 is pressed from outside of the opening of the second hook 5 to the second lock member 17 whereby the second lock member 17 resists the urging force of the urging member 18 and is able to move from the second locked position to the second unlocked position even when the disengagement prevention function by the second lock member 17 is actuated. As a result, the attachment pin can be inserted into the opening of the second hook 5 even when the second lock member 17 is positioned in the second locked position. After the second pin 107 pushes the second lock member 17 away and is inserted into the opening of the second hook 5, the second lock member 17 is returned to the second locked position due to the urging force of the urging member 18. As a result, the second pin 107 is prevented from disengaging from the second hook 5 by the second lock member 17.

The second lock member 17 is held in the second locked position due to the urging force of the urging member 18 even when the expansion force of the hydraulic cylinder 6 is lost due to a breakdown and the like of the system. Because the first connecting pin 7 is pressed by the elastic member 28, the first lock member 16 is held in the first locked position. As a result, the attachment 103 can be held in a working position.

The second lock member 17 is held in the second locked position by the urging force from the urging member 18 even if the first hook 4 is damaged. Therefore, the second pin 107 does not become disengaged from the second hook 5 due to the second lock member 17 and the attachment 103 can be prevented from falling off from the quick coupler 1.

The first lock member 16 is held in the first locked position due to the protruding portion 34 of the hydraulic cylinder 6 pressing the receiving portion 36 of the first lock member 16 even if the second hook 5 is damaged. Therefore, the first pin 106 does not become disengaged from the first hook 4 due to the first lock member 16. As a result, the attachment 103 is prevented from falling off from the quick coupler 1.

Although embodiments of the present invention have been described so far, the present invention is not limited to the above embodiments and various modifications may be made within the scope of the invention.

The shape of the first support hole 26 or the second support hole 27 is not limited to an elongated hole and may be changed. For example, the first support hole 26 may have a circular shape or an elliptical shape larger than the first connecting pin 7. For example, the second support hole 27 may have a circular shape or an elliptical shape larger than the second connecting pin 8.

The first lock member 16 is not limited to the configuration of the above embodiment and may be changed. For example, the recessed portion 35, the inclined surface 37, or the step portion 38 may not be provided on the first lock member 16. The first lock member 16 may move between the first locked position and the first unlocked position with a linear or a curved movement instead of rotating.

The second lock member 17 is not limited to the configuration of the above embodiment and may be changed. For example, the shape of the guide hole 45 of the second lock member 17 may be changed. The guide hole 45 is not limited to the approximately triangular shape and may be another polygonal shape such as a quadrangular shape, or any be an elliptical shape or a circular shape. Alternatively, the guide hole 45 may have a shape that follows the movement of the second connecting pin 8.

The urging member 18 is not limited to a spring and may be configured as another member that produces an urging force such as an elastic material or a fluid such as a gas or a liquid. The elastic member 28 may be omitted. The wall section 15 of the coupler body 2 may be omitted.

The first end portion 22 is included in the cylinder tube 24 and the second end portion 23 is included in the piston rod 25 in the above embodiment. However, the first end portion may be included in the piston rod and the second end portion 23 may be included in the cylinder tube.

INDUSTRIAL APPLICABILITY

According to the present invention, the disengagement prevention function due to the lock member can be automatically actuated when attaching the attachment, and the disengagement prevention function due to the lock member can be automatically released when detaching the attachment.

What is claimed is:

1. A quick coupler comprising:

a coupler body including a first hook;

a movable member including a second hook and supported in a movable manner on the coupler body;

a hydraulic cylinder including a first end portion connected to the coupler body and a second end portion connected to the movable member, the hydraulic cylinder causing the movable member to move so that the second hook moves away from the first hook due to expansion of the hydraulic cylinder, and the hydraulic cylinder causing the movable member to move so that second hook moves closer to the first hook due to contraction of the hydraulic cylinder;

a second connecting pin connecting the second end portion of the hydraulic cylinder and the movable member, a second lock member configured to move to a locked position and an unlocked position, the second lock member protruding into an opening of the second hook in the locked position, and the second lock member retracting from the locked position in the unlocked position; and an urging member urging the second lock member toward the locked position, the movable member including a second support hole that supports the second connecting pin in a movable manner between a lock release position and a lock actuation position along an expansion and contraction direction of the hydraulic cylinder, the second connecting pin moves from the lock release position to the lock actuation position due to the expansion of the hydraulic cylinder, the second connecting pin moves from the lock actuation position to the lock release position due to the contraction of the hydraulic cylinder, the second lock member includes a guide hole disposed so as to overlap the second support hole, the second connecting pin is inserted into the second support hole and the guide hole, and an edge of the guide hole including a first contact portion that is in contact with the second connecting pin while the second connecting pin is positioned in the lock actuation position, a second contact portion that is in contact with the second connecting pin while the second connecting pin is positioned in the lock release position, and a guide portion that extends in a direction that intersects a movement direction of the second connecting pin between the first contact portion and the second contact portion, and the guide portion being pressed by the second connecting pin that moves from the lock actuation position to the lock release position in order to resist an urging force of the urging member and cause the second lock member to move from the locked position to the unlocked position.

2. The quick coupler according to claim 1, wherein the second support hole is an elongated hole that extends along the expansion and contraction direction of the hydraulic cylinder.

3. The quick coupler according to claim 1, wherein the second lock member is supported by the movable member to allow rotation between the locked position and the unlocked position.

4. The quick coupler according to claim 1, wherein the edge of the guide hole further includes a first corner portion including the first contact portion, a second corner portion including the second contact portion, a third corner portion disposed along a movement direction of the second lock member with respect to the first corner portion, a first connecting portion including the guide portion, the first connecting portion connecting the first corner portion and the second corner portion, a second connecting portion connecting the second corner portion and the third corner portion, and a third connecting portion connecting the third corner portion and the first corner portion.

5. The quick coupler according to claim 4, wherein the third corner portion is disposed below a gap with respect to the second connecting pin in the lock actuation position so that the second lock member is moveable from the locked position to the unlocked position while the second connecting pin is positioned in the lock actuation position.

6. The quick coupler according to claim 1, further comprising:

a first lock member configured to move between a locked position and an unlocked position, the first lock member protruding into an opening of the first hook in the locked position, the first lock member retracting from the locked position in the unlocked position; and a first connecting pin connecting the first end portion of the hydraulic cylinder and the coupler body, the coupler body including a first support hole movably supporting the first connecting pin along the expansion and contraction direction of the hydraulic cylinder, and the first end portion of the hydraulic cylinder moving away from the second end portion within a movability range of the first connecting pin in order to move the first lock member from the unlocked position to the locked position.

7. The quick coupler according to claim 6, wherein the first support hole is an elongated hole that extends along the expansion and contraction direction of the hydraulic cylinder.

8. The quick coupler according to claim 6, further comprising:

an elastic member inserted into the first support hole, the elastic member being configured to press the first connecting pin in a direction from the second end portion toward the first end portion.

9. The quick coupler according to claim 6, wherein the first end portion of the hydraulic cylinder moves closer to the second end portion within a movability range of the connecting pin in order to move the first lock member from the locked position to the unlocked position.

* * * * *